US010954027B2

(12) United States Patent
Sasaki

(10) Patent No.: US 10,954,027 B2
(45) Date of Patent: Mar. 23, 2021

(54) PACKAGING CONTAINER AND DISPOSAL METHOD FOR THE SAME

(71) Applicant: TOPPAN PRINTING CO., LTD., Tokyo (JP)

(72) Inventor: Noriyuki Sasaki, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 36 days.

(21) Appl. No.: 16/116,626

(22) Filed: Aug. 29, 2018

(65) Prior Publication Data

US 2020/0071019 A1 Mar. 5, 2020
US 2020/0283189 A9 Sep. 10, 2020

Related U.S. Application Data

(63) Continuation of application No. PCT/JP2016/001572, filed on Mar. 17, 2016.

(51) Int. Cl.

*B65D 5/36* (2006.01)
*B65D 5/54* (2006.01)
*B65D 5/74* (2006.01)

(52) U.S. Cl.

CPC ..... *B65D 5/3628* (2013.01); *B65D 5/54* (2013.01); *B65D 5/741* (2013.01); *B65D 5/3621* (2013.01)

(58) Field of Classification Search

CPC . B65D 65/40; B65D 5/40; B65D 5/54; B65D 5/067; B65D 2565/387; B65D 5/542; B65D 5/5445; B65D 5/563; B32B 3/266; B32B 7/12; B32B 27/10; B32B 27/32; B32B 29/002; B32B 29/005

USPC ..... 229/206, 125.42, 249, 915.1, 101.2, 229/117.01, 235, 237, 214, 240, 5.82, 229/5.84

See application file for complete search history.

(56) References Cited

U.S. PATENT DOCUMENTS 4,679,701 A * 7/1987 Ackermann ..... B65D 77/062 229/117.32
5,014,854 A * 5/1991 Anderson ..... B65D 5/062 229/214
5,897,052 A * 4/1999 Tanaka ..... B65D 5/062 229/205
6,053,402 A * 4/2000 Thomas ..... B65D 5/067 229/120.011

(Continued)

FOREIGN PATENT DOCUMENTS

EP 3 257 771 A1 12/2017
EP 3 323 748 A1 5/2018

(Continued)

OTHER PUBLICATIONS

Taiwanese Office Action dated Jan. 2, 2018 in corresponding application No. 105108619.

(Continued)

*Primary Examiner* — Christopher R Demeree
(74) *Attorney, Agent, or Firm* — Foley & Lardner LLP

(57) ABSTRACT

A packaging container formed by folding a sheet material and includes a container body that has a trunk, a top and a bottom. The trunk serves as side panels, while the top and the bottom are respectively connected to ends of the trunk. In the packaging container, a first weakened portion is linearly formed in the container body.

18 Claims, 14 Drawing Sheets

(56) References Cited

U.S. PATENT DOCUMENTS

| | | | | |
|---|---|---|---|---|
| 8,814,034 | B2 * | 8/2014 | Dickie | B65D 5/746 229/117.01 |
| 2007/0221713 | A1 * | 9/2007 | Wilson | B65D 5/0005 229/101.2 |
| 2010/0078467 | A1 * | 4/2010 | Mortimore | B65D 5/068 229/240 |
| 2014/0272352 | A1 * | 9/2014 | Tilton | B27N 3/04 428/215 |
| 2018/0289564 | A1 * | 10/2018 | Sheehan | B32B 27/34 |

FOREIGN PATENT DOCUMENTS

| | | | |
|---|---|---|---|
| JP | H01-214484 | A | 8/1989 |
| JP | H05-75117 | U | 10/1993 |
| JP | H09-290822 | A | 11/1997 |
| JP | 2002-059971 | A | 2/2002 |
| JP | 2002-332054 | A | 11/2002 |
| JP | 2003-335362 | A | 11/2003 |
| JP | 2005-029212 | A | 2/2005 |
| JP | 3843510 | B2 | 11/2006 |
| JP | 2008-104868 | A | 5/2008 |
| JP | 2008-162611 | A | 7/2008 |
| JP | 2011006075 | A * | 1/2011 |
| JP | 2011-073748 | A | 4/2011 |
| JP | 2012-511475 | A | 5/2012 |
| JP | 2012-166796 | A | 9/2012 |
| JP | 2013-023248 | A | 2/2013 |
| JP | 2013-224172 | A | 10/2013 |
| JP | 5469421 | B2 | 4/2014 |
| JP | 2015-193416 | A | 11/2015 |
| WO | WO-2014/196074 | A1 | 12/2014 |

OTHER PUBLICATIONS

Extended European Search Report dated Feb. 12, 2019 in corresponding application No. 16894274.6.

Japanese Patent Office, "Notification of Reasons for Rejection," issued in connection with Japanese Patent Application No. 2014-192540, dated Dec. 13, 2016.

Japanese Patent Office, "Notification of Reasons for Rejection," issued in connection with Japanese Patent Application No. 2014-221797, dated Aug. 16, 2016.

Japanese Patent Office, "Notification of Reasons for Rejection," issued in connection with Japanese Patent Application No. 2014-192540, dated Aug. 16, 2016.

Chinese Office Action issued in Chinese Application No. 2016800835323 dated Jul. 29, 2019 (27 pages).

* cited by examiner

PACKAGING CONTAINER AND DISPOSAL METHOD FOR THE SAME

TECHNICAL FIELD

The present invention relates to a packaging container and a disposal method for the packaging container.

Background Art

Some packaging containers are formed of a sheet material, such as one disclosed in PTL 1, which is a laminate of a paper substrate layer and a sealant layer made of a thermoplastic resin, with a barrier layer, such as an aluminum foil, aluminum deposited film, or inorganic oxide deposited film, being interposed therebetween. Such a packaging container is formed by folding this sheet material into a box shape, and sealing the ends of the sheet material with each other.

Various modes of such packaging containers are available. In one well-known mode, packaging containers have a gable top panel, which is provided with a spout plug made of polyethylene or the like, so that the liquids inside the container can be poured out. When such a packaging container is discarded through a specialized refuse collection service, the spout plug may be separated from the container body made of the paper sheet material, by opening up the top sealing portion and cutting the container body around the spout plug with scissors or the like. For packaging containers having no spout plug, the container body is disassembled to reduce the volume of the refuse before being discarded.

PTL 2 discloses a liquid packaging paper container having a container body sealed by overlapping both ends of the paper base sheet. The container body has a side sealing portion provided with a pull tab which is peelable via a peelable layer that is formed of an easily peelable tape-shaped film. According to this liquid packaging paper container, the pull tab is pulled to peel off the side sealing portion, or the pull tab provided to a side panel is pulled to break the side panel to facilitate separation of the liquid packaging paper container body into its constituent parts.

PTL 3 discloses a paper packaging body where a spout having an easily-breakable portion is attached to the paper container having a folding guiding line. According to this paper packaging body, the paper container is folded along the folding guiding line to break the easily-breakable portion of the spout, so that the spout can be separated from the paper container.

CITATION LIST

[PTL] PTL 1: JP 2003-335362 A; PTL 2: JP 3843510 B2; PTL 3: JP 5469421 B2

SUMMARY OF THE INVENTION

Technical Problem

However, the liquid packaging paper container of PTL 2 needs to have the easily peelable tape-shaped film, while there is a concern that sealing of the bonding portions of the trunk may become unstable due to the presence of the easily peelable tape-shaped film. According to the method disclosed in PTL 3, although the spout can be detached, the paper container body cannot be disassembled.

The present invention has been made in light of the issues set forth above, and has an object to provide a packaging container having a simple structure and can be more stably disassembled, and a disposal method for the packaging container.

Solution to Problem

An aspect of the present invention for attempting to solve the issues set forth above is a packaging container formed by folding a sheet material and including a container body that has a trunk, a top and a bottom. The trunk serves as side panels, while the top and the bottom are respectively connected to ends of the trunk. In the packaging container, a first weakened portion is linearly formed in the container body.

Another aspect of the present invention is a disposal method for the packaging container mentioned above. The disposal method includes a step of compressing the trunk and the top of the packaging container; a step of folding the packaging container along the weakened portion; a step of at least partially breaking the compressed packaging container by folding the same along a first weakened portion linearly formed in the container body; and a step of separating the packaging container along the broken portion extending along the first weakened portion.

Desired Advantageous Effects of the Invention

The present invention provides a packaging container having a simple structure and can be more stably disassembled, and a disposal method for the same.

DESCRIPTION OF THE EMBODIMENTS

Figure 1:
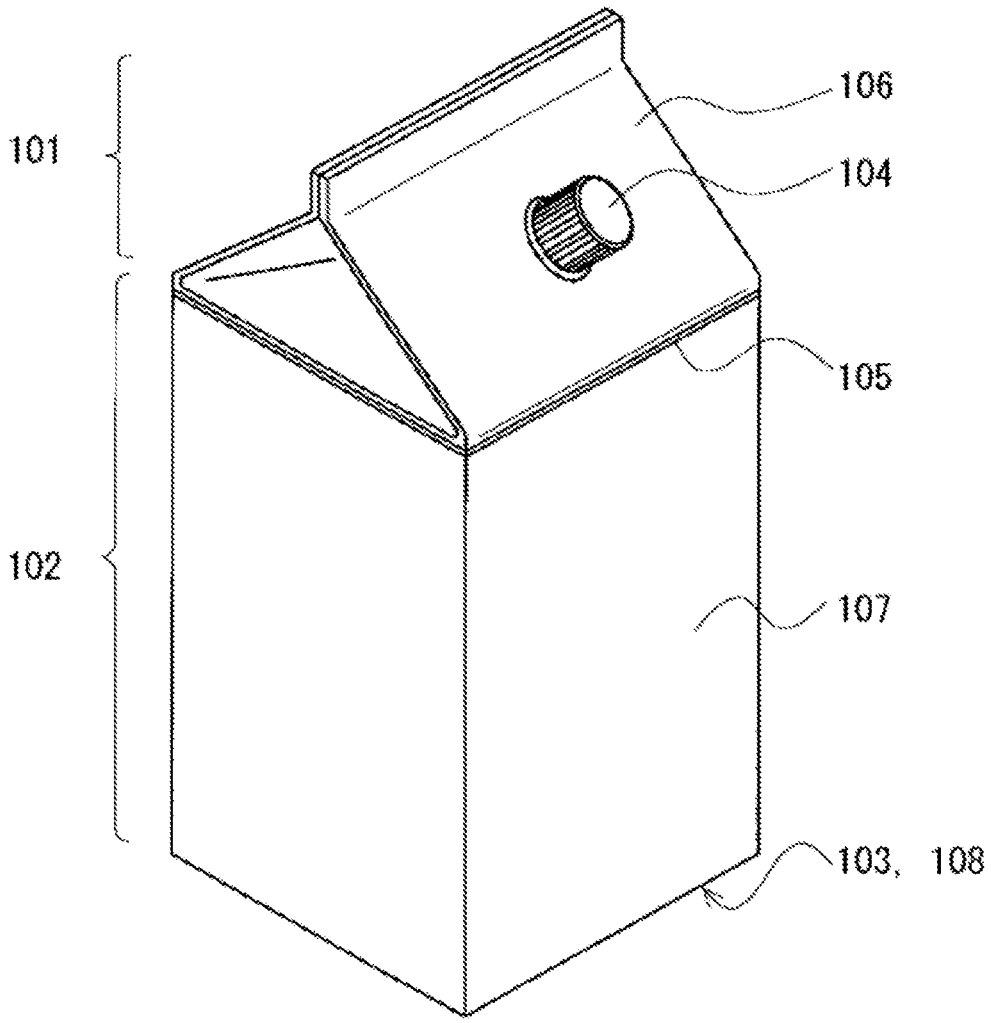
FIG. 1 is a perspective view illustrating a packaging container according to a first embodiment of the present invention.

With reference to the drawings, preferred or representative embodiments of the present invention will be described in detail. It is to be understood that the present invention is not limited to the following embodiments, which are intended to be representative of the present invention. The representative embodiments described below are merely examples of the present invention, and the design thereof could be appropriately changed by one skilled in the art. In the embodiments, the same or corresponding components are denoted by the same reference characters, and duplicate description thereof will be omitted.

First Embodiment

FIG. 1 is a perspective view illustrating a packaging container 1 according to a first embodiment of the present invention. The packaging container 1 is formed by folding a blank into a box shape and sealing the ends with each other. The packaging container 1 is made up of a top 101, a trunk 102 and a bottom 103. The top 101 is made up of two top panels 106. One of the top panels 106 is provided with a spout plug 104 having a spout for pouring liquid contained in the packaging container 1, and a cap for closing the spout. The packaging container 1 is linearly provided with a weakened portion 105 around the trunk at a level where parts of the linear weakened portion 105 align with each other in plan view when the packaging container 1 is compressed.

Figure 2:
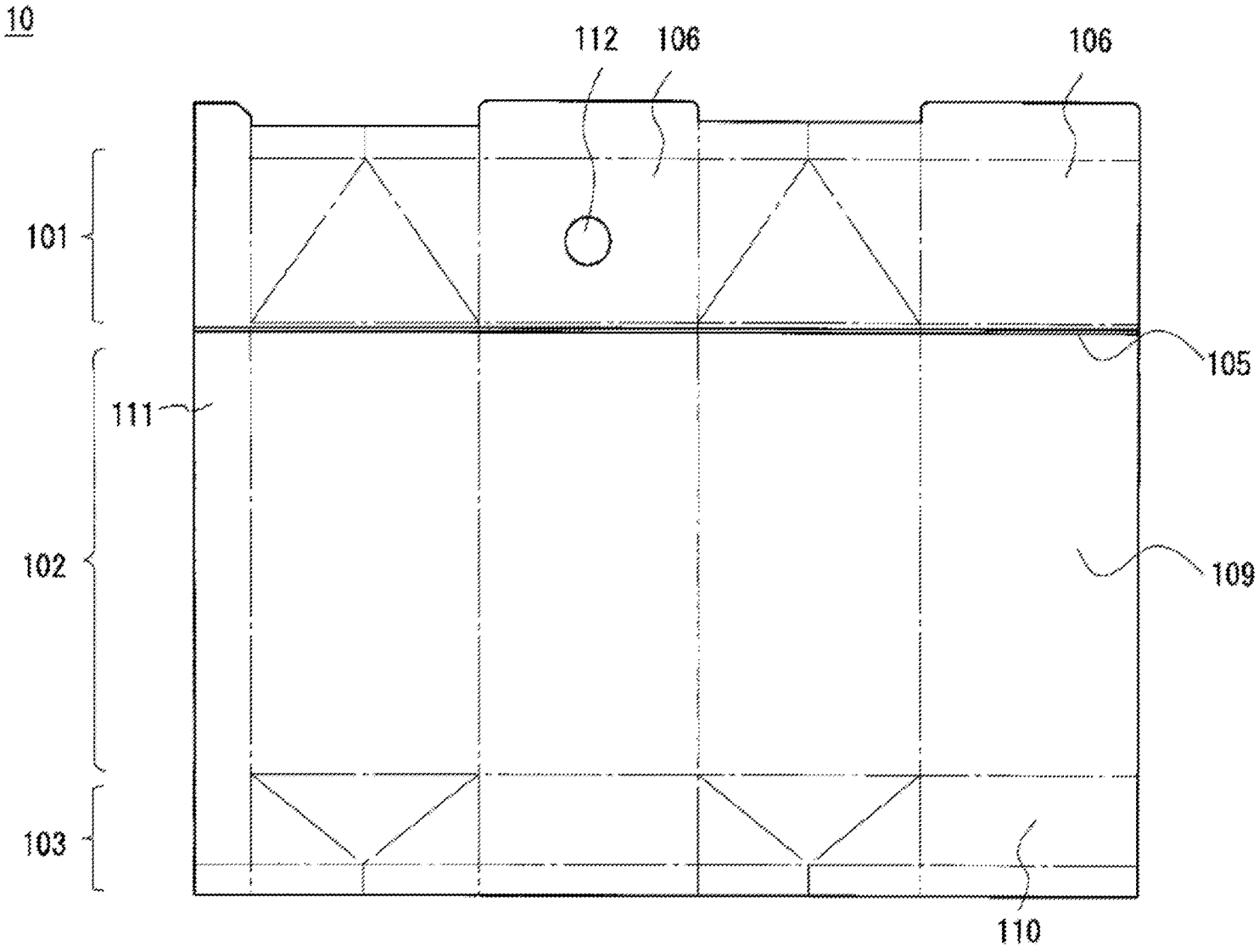
FIG. 2 is a diagram illustrating a blank of the packaging container according to the first embodiment of the present invention.

FIG. 2 shows a blank 10 that is a material for the packaging container 1. The packaging container 1 includes the top panels 106 forming the top 101, side panels 109 forming the trunk 102, and bottom panels 110 forming the bottom 103. The blank 10 has a sealing portion 111 at an end. The blank 10 is folded along the dash-dot line of FIG. 2 and the sealing portion 111 is sealed to the other end to form the blank 10 into a box shape. One of the top panels 106 is provided with a spout opening 112 where the spout is inserted and fixed. As an example, the linear weakened portion 105 is formed in an area where the top 101 contacts the side panels 109. The linear weakened portion 105 extends in the width direction of the trunk 102 (horizontal direction as viewed in FIG. 2).

Figure 3A:
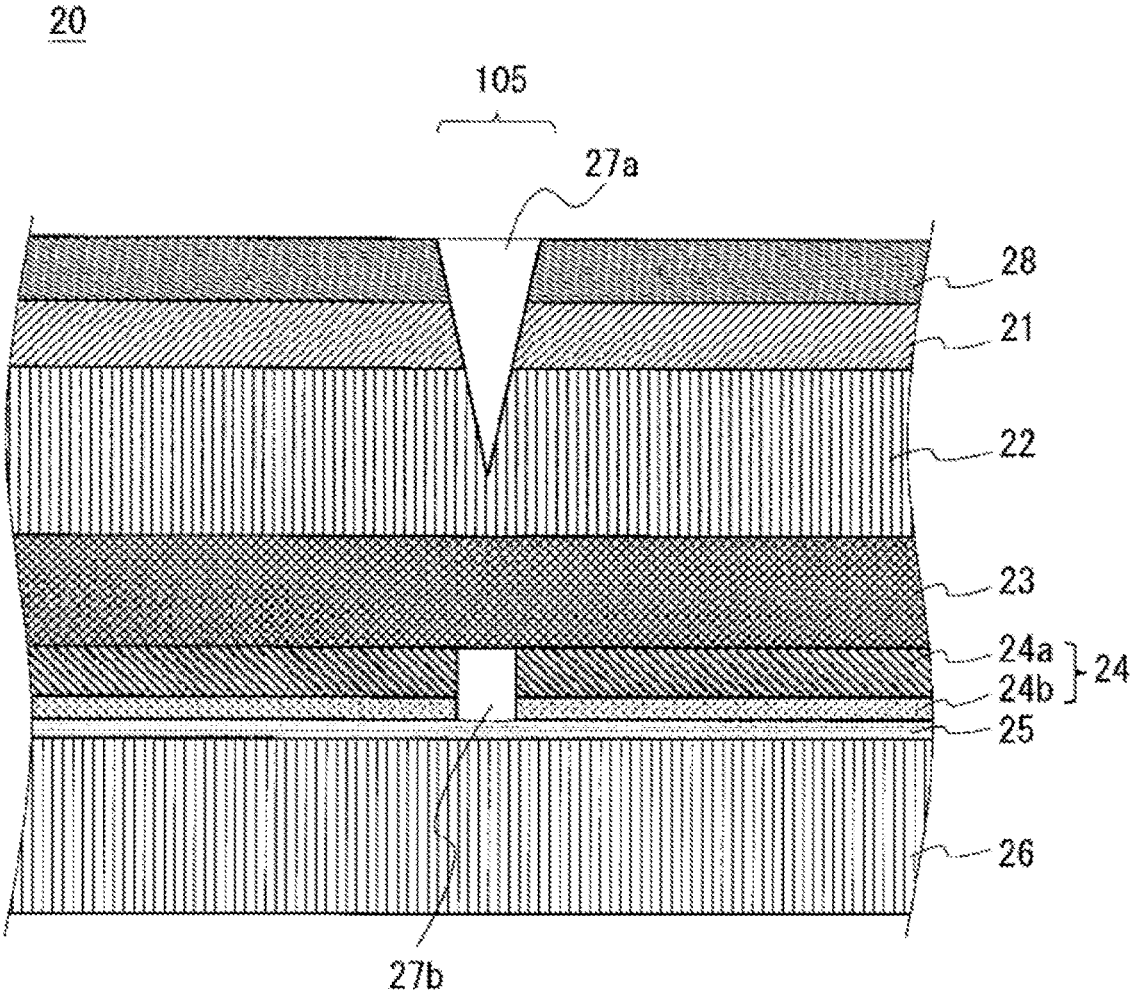
FIG. 3A is a cross-sectional view illustrating an example of a sheet material according to the first embodiment of the present invention.
Figure 3B:
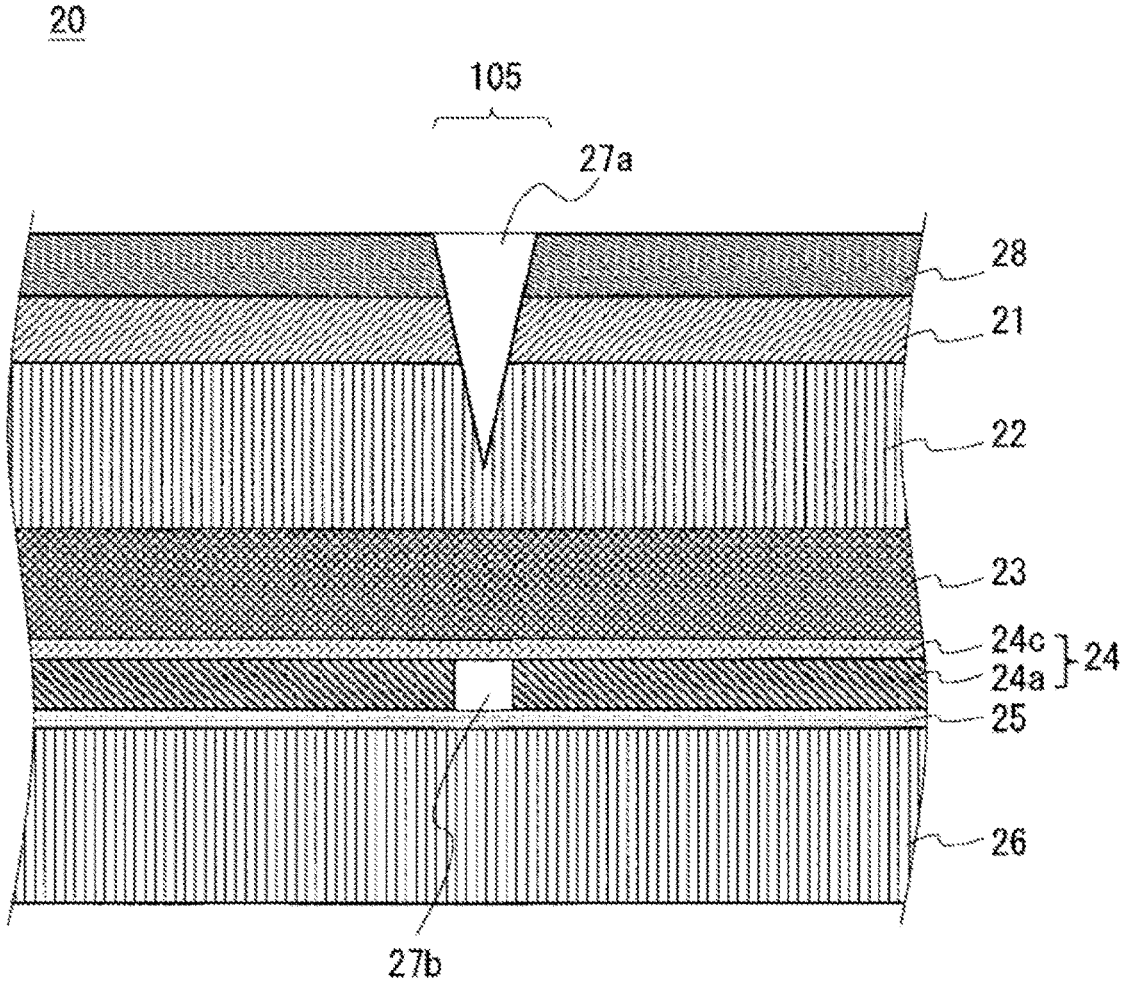
FIG. 3B is a cross-sectional view illustrating another example of a sheet material according to the first embodiment of the present invention.

FIGS. 3A and 3B each show a schematic cross-sectional view of an example of a laminated structure of a sheet material 20 used for the blank 10. From the outside toward the inside of the packaging container 1, the sheet material 20 includes a printed layer 28/a thermoplastic resin layer 21/a paper base layer 22/an adhesive resin layer 23/a barrier layer 24/an adhesive layer 25/a sealant layer 26 in this order. The difference between the examples shown in FIGS. 3A and 3B will be described later.

As shown in FIGS. 3A and 3B, the weakened portion 105 of the sheet material 20 is configured by groove-shaped score lines 27*a* and 27*b* which are formed with a predetermined depth at least in the paper base layer 22 and the barrier layer 24. The score line 27*b* of the barrier layer 24 is formed so as to align with the score line 27*a* of the paper base layer 22. In this case, the score line 27*a* is preferably provided at a depth not penetrating the barrier layer 24, but there is no problem if it partially penetrates the barrier layer, because penetrating the barrier layer in a partial small range would not affect the barrier properties. The score line 27*a* may be formed at least in the paper base layer 22, or, in addition to the paper base layer 22, may be formed, as shown in FIGS. 3A and 3B, in the thermoplastic resin layer 21 and the printed layer 28 both of which are laminated on the outer side of the paper base layer 22.

The score line 27*a* may be formed with a depth of allowing the paper base layer 22 to ensure strength of the packaging container 1. The score line 27*a* may be formed through a half blanking process or a full blanking process by use of a blade die. When using a full blanking process, the score line 27*a* may be formed in a perforated shape to ensure strength of the packaging container 1. The score line 27*b* may be formed by laser irradiation after bonding surfaces of the barrier layer. However, when forming the score line 27*b* before bonding of the barrier layer, half or full blanking process may be used. The score line 27*b* may be formed by laser processing even before bonding of the barrier layer. The score line 27*b* may also be formed in a perforated shape to ensure strength.

The thermoplastic resin layer 21 may be formed on the paper base layer 22 such as by extrusion lamination, using a low-density polyethylene resin (LDPE), a linear low-density polyethylene resin (LLDPE), or the like.

On the outer side of the thermoplastic resin layer 21, a printed layer 28 may be provided to display a pattern or product information. The printed layer 28 may be formed through a method such as of gravure printing or offset printing, by using a well-known ink. Corona treatment or other adhesion enhancing treatment may be applied to the thermoplastic resin layer 21 to enhance adhesion thereof to the printed layer 28. An overcoat layer may be provided on the outer side of the printed layer 28 to improve wear resistance or surface decorativeness.

For the paper base layer 22, paperboard such as milk carton base paper may be used. Basis weight and density may be appropriately selected depending on the capacity and design of the container, but it is preferable that the basis weight is in the range of 200 $g/m^2$ or more and 500 $g/m^2$ or less, and the density is in the range of 0.6 $g/cm^3$ or more and 1.1 $g/cm^3$ or less.

The adhesive resin layer 23 is made of a polyolefin-based resin that is able to bond the paper base layer 22 to the barrier layer 24. Specifically, high density polyethylene resin (HDPE), medium density polyethylene resin (MDPE), LDPE, LLDPE, ethylene methacrylic acid copolymer (EMAA), ethylene acrylic acid copolymer (EAA), ionomer, polypropylene (PP) or the like may be used. Ordinarily, an adhesive resin layer 23 with a thickness of 10 μm or more and 60 μm or less is used. To enhance adhesion strength, corona treatment, ozone treatment, anchor coating or the like may be applied to a surface of the paper base layer 22 or the barrier layer 24. Alternatively, an adhesive layer using a dry laminate adhesive or the like may be provided instead of the adhesive resin layer.

Films used for the barrier layer 24 may be deposited films including a base film 24*a*, and a vapor-deposited layer 24*b* on which a metal such as aluminum, or silica, alumina or the like is vapor-deposited, and a laminated film in which a metal foil 24*c* such as of aluminum is dry-laminated on a base film 24*a*. In the example shown in FIG. 3A, the barrier layer 24 is a deposited film configured by a base film 24*a*, and a vapor-deposited layer 24*b* provided on a surface serving as an inner surface of the packaging container 1. In the example shown in FIG. 3B, the barrier layer 24 is a laminated film configured by a base film 24*a*, and a metal foil 24*c* provided on a surface serving as an outer surface of the packaging container 1. If a deposited film is used, the thickness of the vapor-deposited layer is preferably in the range of 5 nm or more and 100 nm or less. If a laminated film is used, the thickness of the metal foil is preferably in the range of 5 μm or more and 15 μm or less. If a laminated film is used and the score line 27*b* is formed by irradiating laser, the barrier layer 24 is laminated such that, as shown in FIG. 3B, the metal foil 24*c* faces the adhesive resin layer 23. This way of lamination can prevent laser irradiation of the base film 24*a* from being obstructed by the metal foil 24*c*. Materials that can be used for the barrier layer 24 include a polyethylene terephthalate film that has been subjected to barrier coating, and a barrier film made of a barrier material such as EVOH.

Materials that can be used for the base film 24*a* include a resin film such as of polyethylene terephthalate (PET), nylon, polypropylene (PP) or the like. In particular, a biaxially stretched film of PET is preferable, since it is less likely to expand or contract during vapor deposition or bonding. The base film 24*a* may have a thickness in the range of 6 μm or more and 25 μm or less, but may preferably have a thickness of 12 μm or more to prevent contraction due to the heat of laser.

For the adhesive layer 25, an adhesive for dry lamination or an adhesive for non-solvent lamination may be used, or a polyolefin-based resin may be extruded for adhesion. The adhesive layer 25 preferably has a thickness in the range of 5 μm or more and 20 μm or less. The quantity of dry coating is preferably in the range of 0.5 $g/m^3$ or more and 7.0 $g/m^3$ or less.

Materials that can be used for the sealant layer 26 include HDPE, MDPE, LDPE, LLDPE and the like. A layer partially containing polybutene may be additionally provided. Of the materials mentioned above, LLDPE is particularly suitable, with a preferable density being 0.925 or less and a preferable melt index (MI) being 4 or more. The sealant layer 26 preferably has a thickness in the range of 30 μm or more and 100 μm or less. A non-stretched film produced by a T-die method or inflation method is preferably used for the sealant layer 26.

Figure 4A:
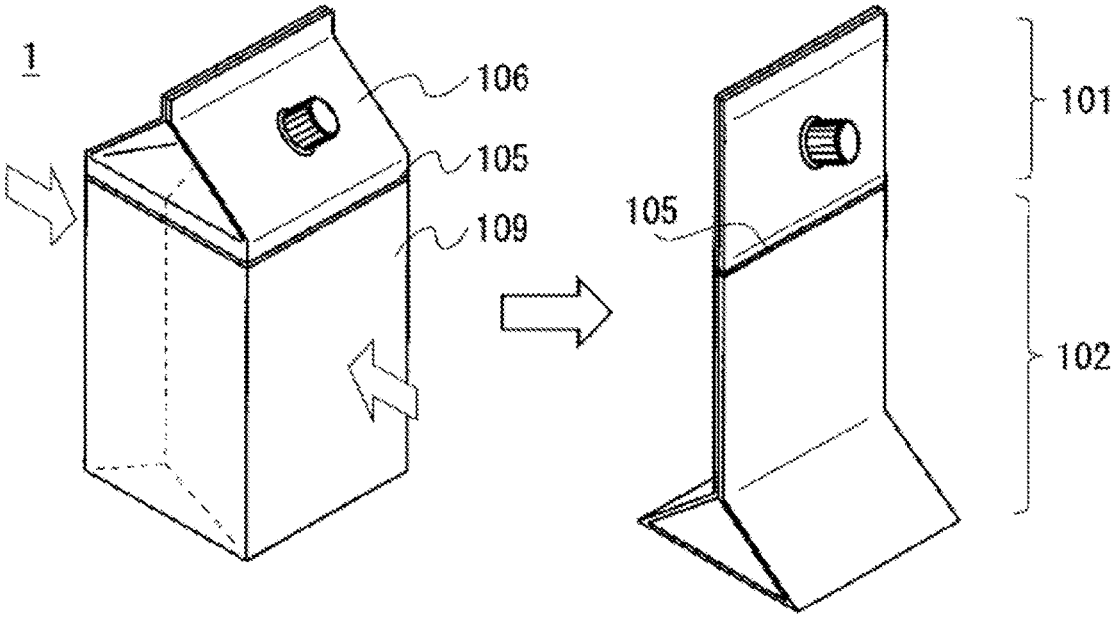
FIG. 4A is a diagram illustrating a disposal method for the packaging container according to the first embodiment of the present invention.
Figure 4B:
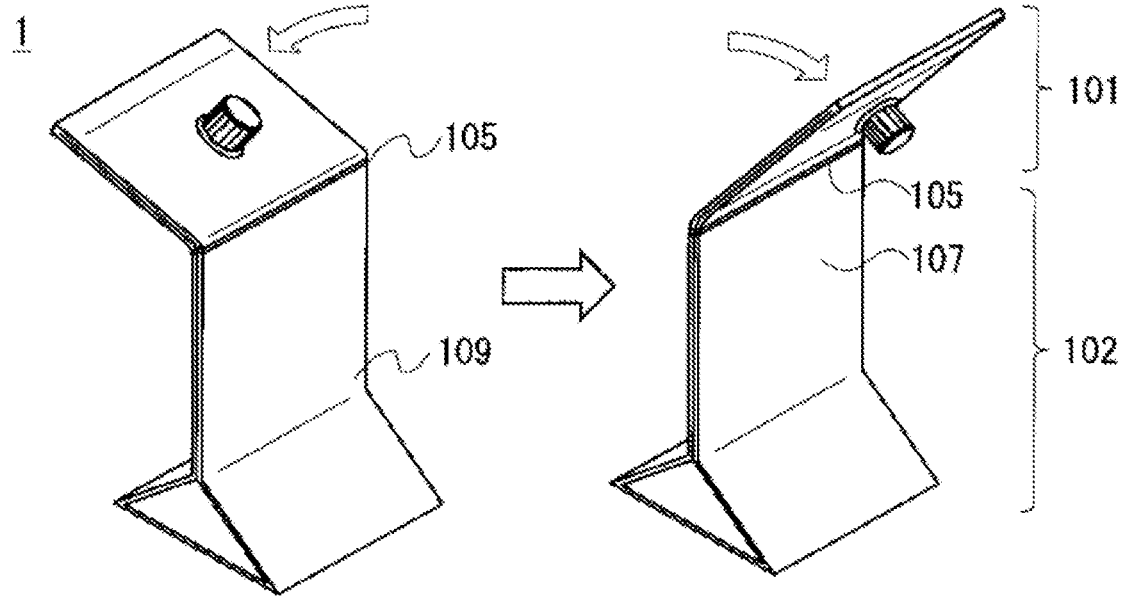
FIG. 4B is a diagram illustrating a disposal method for the packaging container according to the first embodiment of the present invention.
Figure 4C:
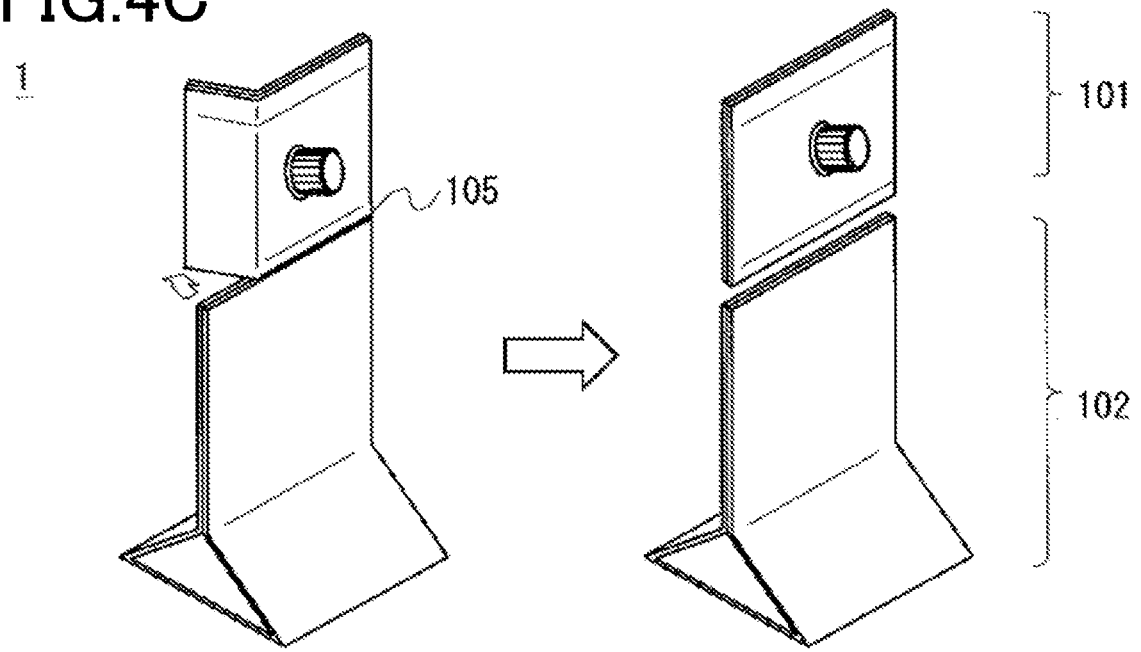
FIG. 4C is a diagram illustrating a disposal method for the packaging container according to the first embodiment of the present invention.

FIGS. 4A, 4B and 4C show a disposal method for the packaging container 1 according to the first embodiment of the present invention. Referring to FIGS. 4A, 4B and 4C, individual steps of the embodiment will be described.

<Compressing Step>

FIG. 4A shows a step of compressing the packaging container 1. In this step, the user of the packaging container 1 compresses the trunk 102 of the packaging container 1 by compressing opposing two panels among the side panels 109 constituting the trunk 102 in a direction for the two panels to contact each other. The two compressed side panels 109 extend downward from the respective top panels 106. The remaining two panels 109 orthogonally joining the former two panels are folded inward of the packaging container 1 by the compression.

The compressed packaging container 1 is shown on the right in FIG. 4A. Thus, by compressing the packaging container 1, parts of the weakened portion 105 formed all around the trunk 102 are aligned in plan view.

<Folding and Breaking Step>

FIG. 4B shows a step of folding and breaking the packaging container 1 along the weakened portion 105. In this step, the user folds the compressed packaging container 1 along the weakened portion 105 as shown in FIG. 4B.

Further, as shown on the right in FIG. 4B, the user may fold the compressed packaging container 1 in the direction opposite to the initial folding direction, along the weakened portion 105. The folding direction of the packaging container 1 may only be one, as long as the breakage sufficient for facilitating the separating step described below is caused. By folding the packaging container 1 once or twice or more in this way, the packaging container 1 is at least partially broken along the weakened portion 105.

<Separating Step>

FIG. 4C shows a step of separating part of the packaging container 1, whose weakened portion 105 has been broken, from the rest of the container along the broken portion. In this step, as shown in FIG. 4C, the user pulls away the top 101 along the weakened portion 105 starting from the broken portion to separate the top 101 from the trunk 102. Since at least part of the weakened portion 105 has been broken, the user can pull away the top 101 along the weakened portion 105 with only a little strength in the folding and breaking step. As shown on the right in FIG. 4C, the packaging container 1 is separated into the top 101 and the trunk 102.

Second Embodiment

Figure 5:
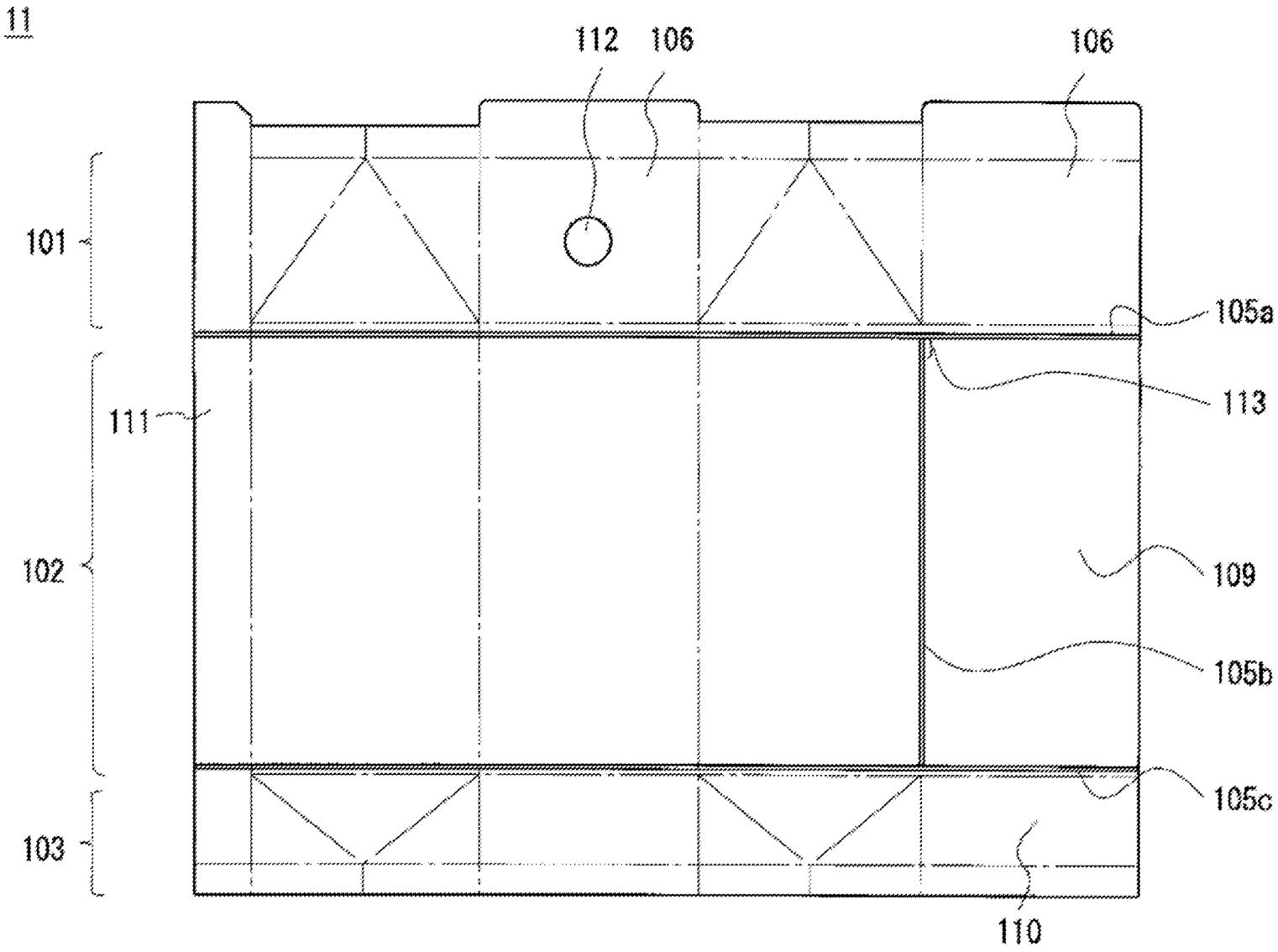
FIG. 5 is a diagram illustrating a blank of a packaging container according to a second embodiment of the present invention.

FIG. 5 shows a blank 11 of a packaging container 3 according to a second embodiment of the present invention. In the following description, the components identical with or corresponding to those of the packaging container 1 are given the same reference signs to appropriately omit redundant description.

In the packaging container 3, three weakened portions are formed. A first weakened portion 105*a* is formed at the same position as that of the weakened portion 105 of the packaging container 1. A second weakened portion 105*b* is linearly formed throughout the length of the trunk 102 in the height direction, with the upper end contacting the first weakened portion 105*a* and the lower end contacting a third weakened portion 105*c* described below. The third weakened portion 105*c* is linearly formed along an edge of the bottom 103. Since the lamination structure of the sheet material is the same as that of the packaging container 1, description is omitted.

Similarly to the packaging container 1, the first and third weakened portions 105*a* and 105*c* are each made up of score lines 27*a* and 27*b* which are respectively formed in the paper base layer 22 and the barrier layer 24 at a predetermined depth. The second weakened portion 105*b* has a cutoff-start section 113 extending only over a small length (e.g., on the order of 2 mm) from the upper end contacting the first weakened portion 105*a*. In the cutoff-start section 113, the score lines 27*a* and 27*b* are respectively formed in the paper base layer 22 and the barrier layer 24 at a predetermined depth as in the first and third weakened portions 105*a* and 105. In the remaining section reaching the third weakened portion 105*c*, only the paper base layer 22 is provided with the score line 27*a*. Since the method of forming the score lines 27*a* and 27*b* is the same as that of the packaging container 1, description is omitted.

Figure 6A:
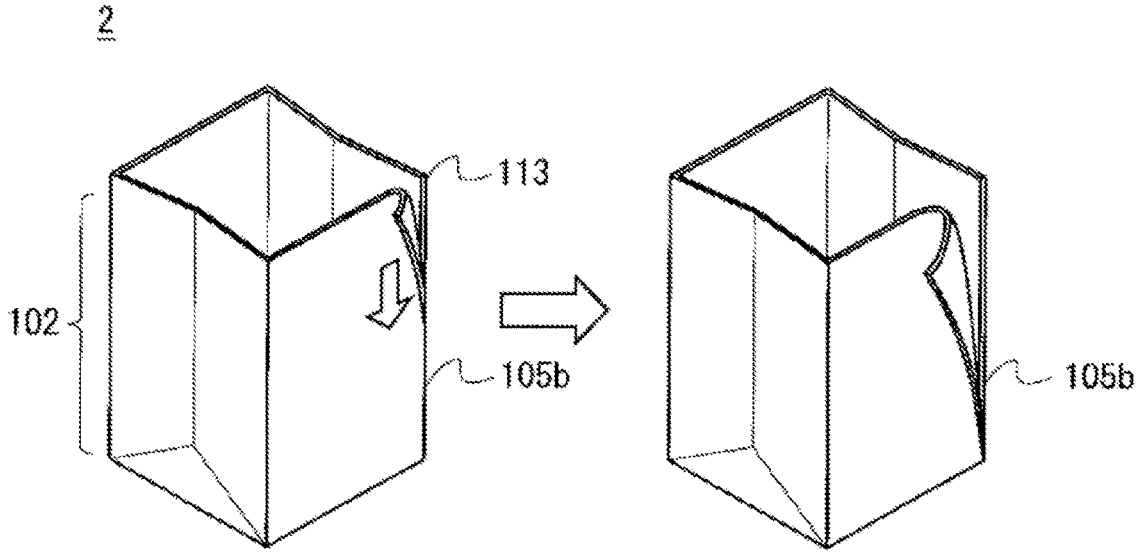
FIG. 6A is a diagram illustrating a disposal method for the packaging container according to the second embodiment of the present invention.
Figure 6B:
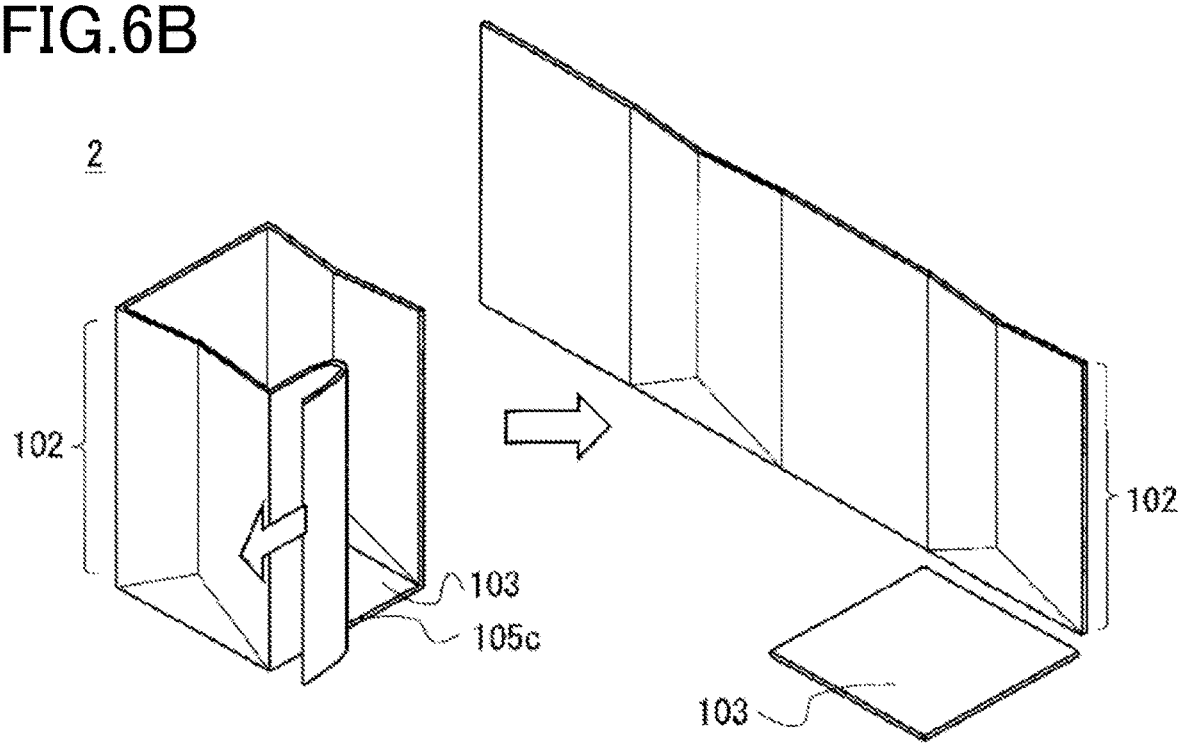
FIG. 6B is a diagram illustrating a disposal method for the packaging container according to the second embodiment of the present invention.

FIGS. 6A and 6B show part of a disposal method for the packaging container 3 according to the second embodiment of the present invention. Referring to FIGS. 6A and 6B, individual steps of the present embodiment will be described.

<Compressing Step—Folding and breaking Step—Separating Step

In these steps, the user separates the packaging container 3 into the top 101 and the trunk 102 in steps similar to those of the disposal method according to the first embodiment. Since these steps are the same as those of the first embodiment, description is omitted.

<Trunk Cutting Step>

FIG. 6A shows a step of cutting the trunk 102 of the packaging container 3. In this step, the user cuts the trunk 102 along the second weakened portion 105*b*. The second weakened portion 105*b* has the upper end provided with the cutoff-start section 113 in which both the paper base layer 22 and the barrier layer 24 are scored. Therefore, the user can easily start cutting the trunk 102, as a trigger for the further cutting. Furthermore, the strength of the trunk 102 is prevented from being reduced because of the absence of the score line 27*b* from the barrier layer 24 of the second weakened portion 105*b* excluding the cutoff-start section 113.

<Bottom Separating Step>

FIG. 6B shows a step of separating the bottom 103 of the packaging container 3. In this step, the user pulls away the trunk 102 along the third weakened portion 105*c*, which is linearly formed along an edge of the bottom 103, for separation from the bottom 103. As a result, as shown on the right in FIG. 6B, the trunk 102 and the bottom 103 of the packaging container 3 are separated from each other. The trunk 102, which has been cut in the height direction in the trunk cutting step, is unfolded in this step.

In the embodiments described above, a gable top packaging container provided with a spout plug has been used. However, as long as the packaging container is one formed by folding a sheet material into a box shape, the embodiments may be applied to a brick-shaped packaging container or a packaging container without a spout plug.

As described above, the present invention provides a disposal method for a packaging container having a simple structure and can be more stably disassembled by additionally providing a score line to a packaging container of the conventional art.

In the embodiments described above, the way to provide the weakened portions is not limited to the methods described above, as long as the contents are adequately packaged. For example, when providing the weakened portions, the paper base layer may either be fully cut or fully perforated, or half cut or half perforated from the outside of the packaging container. Alternatively, the weakened portions may be provided in the paper base layer alone, or may be provided penetrating the thermoplastic resin layer or the printed layer. When providing the weakened portions, the barrier layer may be cut in any way, fully or half, unless the sealant layer is penetrated. The cutting may penetrate the barrier layer and reach another intermediate layer. Moreover, these weakened portions may each be formed of two or more closely located linear grooves.

Third Embodiment

Figure 7:
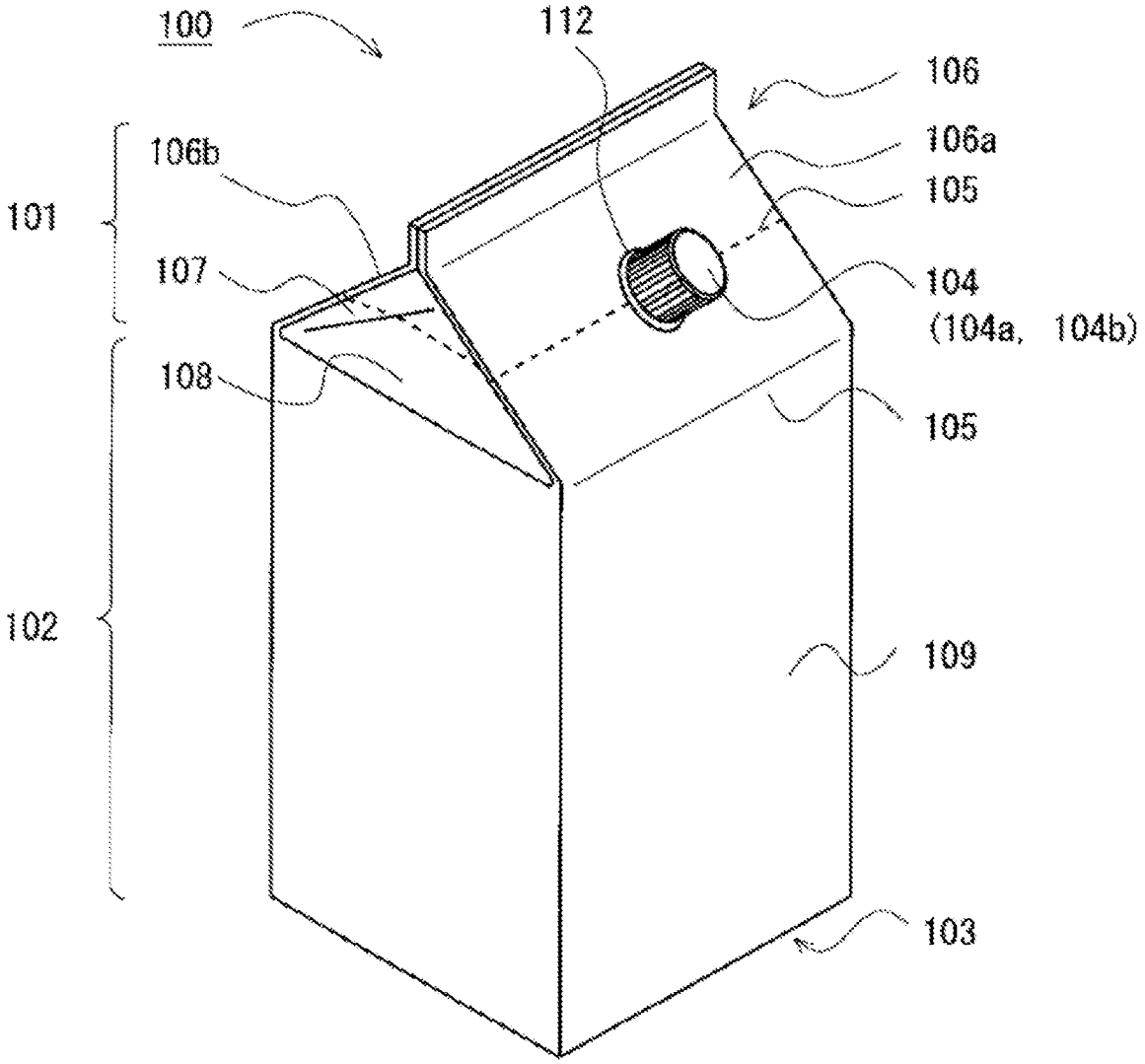
FIG. 7 is a perspective view illustrating a packaging container according to a third embodiment of the present invention.

FIG. 7 is a perspective view illustrating a packaging container 1 according to a third embodiment of the present invention. Similarly to the packaging container according to the first and second embodiments, a packaging container 1 includes a container body 100 and a spout plug 104. The container body 100 is formed by folding a blank made of a processed sheet material into a box shape, and sealing the ends with each other. The spout plug 104 is a pouring tool made of a resin. The container body 100 includes a top 101 that serves as a top part when the container body 100 stands upright, a trunk 102 that serves as side panels, and a bottom 103 that serves as a bottom part. The top 101 includes two top panels 106 (106*a*, 106*b*), and inward-folding panels 107 and outward-folding panels 108 which are both folded in between the top plates 106. The top panel 106*a* is provided with a circular spout opening 112. The spout plug 104 includes a spout 104*a* and a cap 104*b*, and is mounted to the spout opening 112. In the present embodiment, the top 101 is provided with a weakened portion 105 having a lowered breaking strength in a width direction that is a horizontal direction when the container body stands upright. For the sheet material, one having a layer structure similar to that of the first embodiment may be used.

Figure 8:
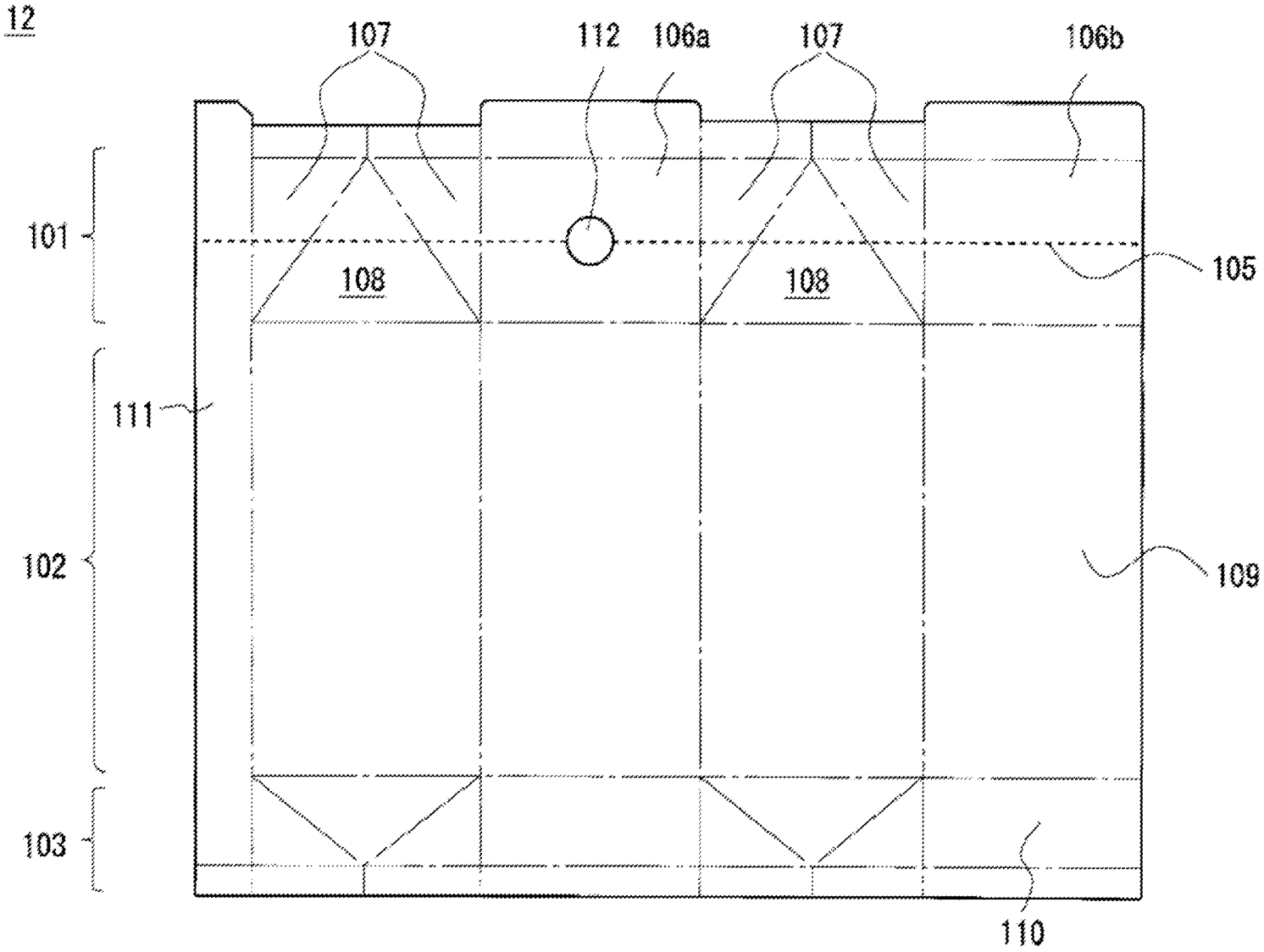
FIG. 8 is a plan view illustrating a blank according to the third embodiment of the present invention.

FIG. 8 is a plan view illustrating a blank 12 that is an example of a blank serving as the material for the container body 100. The blank 12 has the top panels 106*a* and 106*b*, and the inward- and outward-folding panels 107 and 108 configuring the top 101, four side panels 109 configuring the trunk 102, bottom panels 110 configuring the bottom 103, and a sealing portion 111 formed at an end. The blank 12 is folded along the dash-dot lines of FIG. 8, and the sealing portion 111 is sealed to the opposite end to form the blank 12 into a box shape. Near the center of the top panel 106*a*, the spout opening 112 for inserting and fixing the spout plug 104 is formed. The weakened portion 105 is linearly formed substantially all around the top panels 106*a* and 106*b*, the outward-folding panels 107 and 108 in the width direction that is the horizontal direction when the container body 100 stands upright. Part of the weakened portion 105 is interrupted by the spout opening 112. Namely, the crease formed when the container body 100 is folded along the weakened portion 105 crosses over the spout opening 112.

Figure 9A:
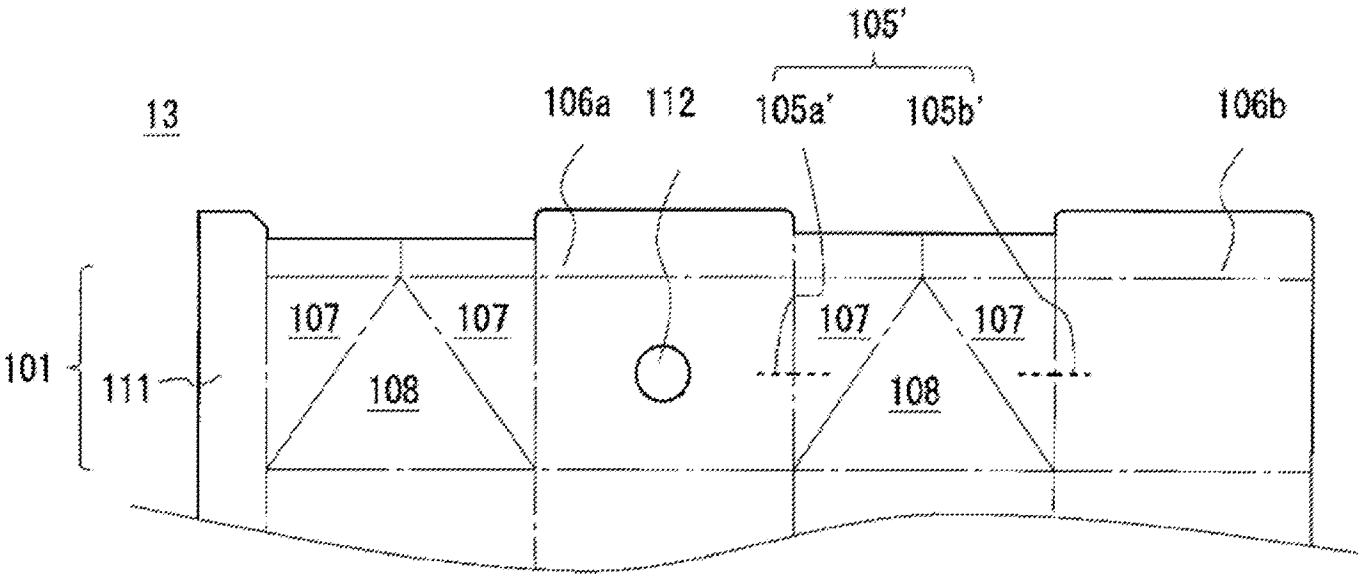
FIG. 9A is a plan view illustrating a blank according to a modification of the third embodiment of the present invention.

FIG. 9A is a plan view illustrating a top 101 and the vicinity thereof of a blank 13 that is a modification of the blank 12. The blank 13 differs from the blank 12 in the position of the weakened portion. As shown in FIG. 9A, the blank 13 has a weakened portion 105' including weakened portions 105'*a* and 105'*b* which are each formed in a predetermined region crossing the boundary between the top panel 106*a* or 106*b* and the inward-folding panel 107. Both of these weakened portions are linearly formed extending in the width direction that is the horizontal direction when the container body 100 stands upright. The crease created by folding the container body 100 along the weakened portion 105' crosses over the spout opening 112.

Figure 9B:
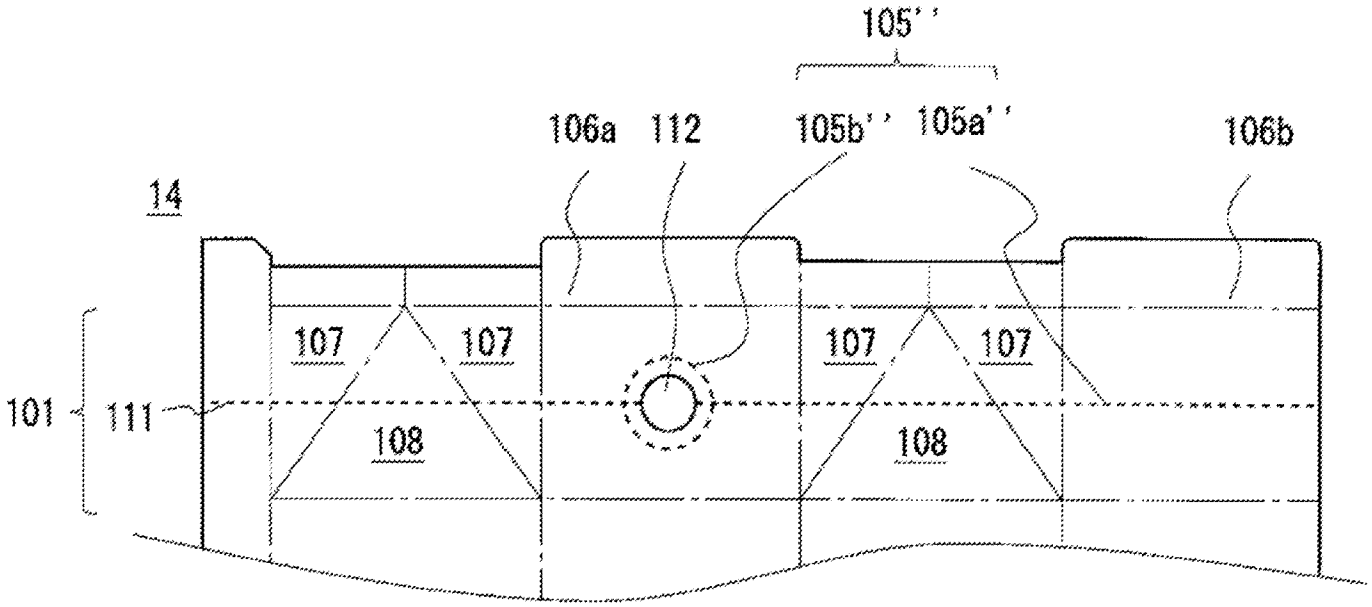
FIG. 9B is a plan view illustrating a blank according to a modification of the third embodiment of the present invention.

FIG. 9B is a plan view illustrating a top 101 and the vicinity thereof of a blank 14 that is a modification of the blank 12. The blank 14 differs from the blank 12 in the position of the weakened portion. As shown in FIG. 9B, the blank 14 has a weakened portion 105" which includes not only a weakened portion 105*a*" formed at the same position as that of the weakened portion 105 of the blank 12, but also a weakened portion 105*b*" formed around the spout opening 112. The crease created by folding the container body 100 along the weakened portion 105*a*" crosses over the spout opening 112. It should be noted that the crease created by folding the container body 100 along the weakened portion 105*a*" only has to cross over the spout opening 112, and accordingly, may or may not contact the weakened portion 105*b*" or the spout opening 112. In the following description, the weakened portion 105, as far as it is so referred to, should include the weakened portion 105' or the weakened portion 105" unless otherwise mentioned. Sheet materials used for the blanks below may be ones similar to the one used in the first or second embodiment.

Figure 10A:
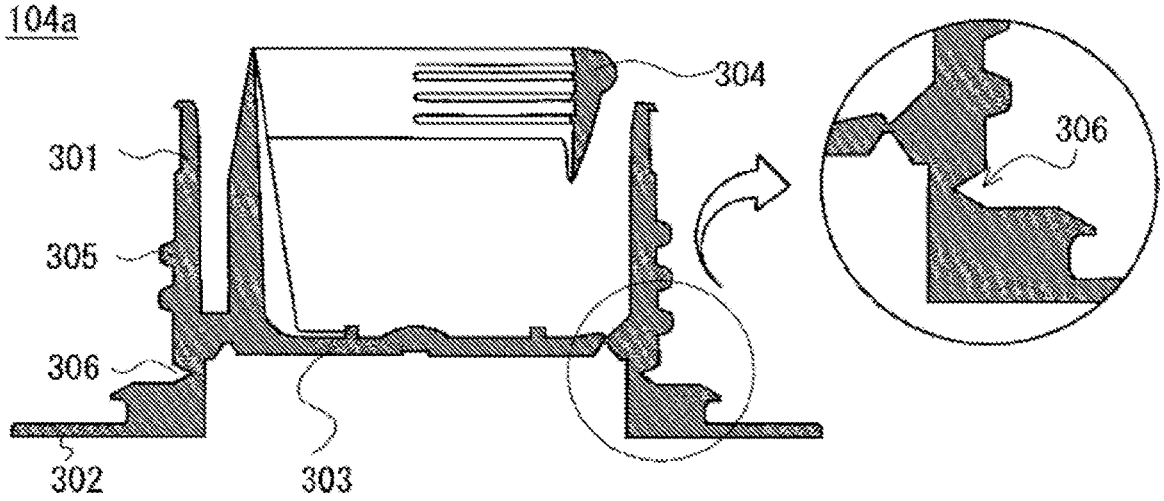
FIG. 10A is a cross-sectional view illustrating a spout according to an embodiment of the present invention.

FIG. 10A is a cross-sectional view illustrating the spout 104*a*. The spout 104*a* includes a cylindrical side wall 301, a disk-like flange 302 extending outward from a lower end of the side wall 301, a disk-like partition wall 303 internally formed at the lower end of the side wall 301 to close the interior of the packaging container against the exterior, and a pull tab 304 extending upward from the partition wall 303 and used when the user detaches the partition wall 303. The side wall 301 has an outer periphery in which an external screw 305 is formed for threadable engagement with an internal screw formed in the inner periphery of a cap 104*b*. After the side wall 301 has been inserted into the spout opening 112, the spout 104*a* is fixed by the flange 302 being bonded to the top panel 106*a* around the spout opening 112 by ultrasonic welding or the like. The side wall 301 has a lower part that is near the joint between itself and the flange 302, where a thin portion 306 is continuously or intermittently formed in the outer periphery of the side wall 301, with the thickness being reduced.

Figure 10B:
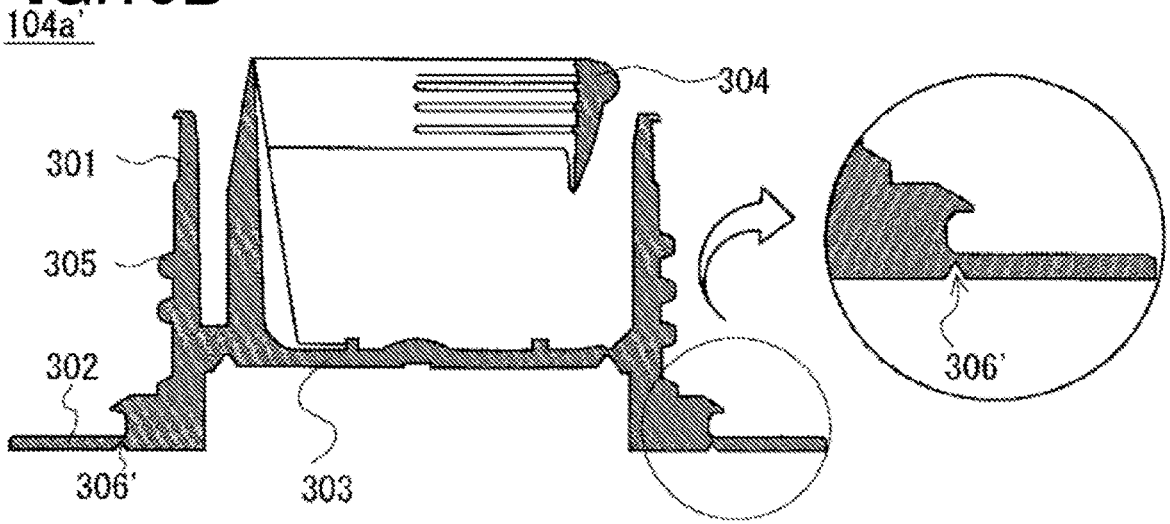
FIG. 10B is a cross-sectional view illustrating a spout according to an embodiment of the present invention.

FIG. 10B shows a spout 104*a*' according to a modification of the spout 104*a*. The spout 104*a*' differs from the spout 104*a* in the position where a thin portion 306' is formed. As shown in FIG. 10B, the thin portion 306' is annularly formed in a continuous or intermittent manner on the lower surface of the flange 302 by reducing the thickness of the flange 302. The surface for forming the thin portion is not limited to the lower surface, but may be the upper surface, or may be both.

Figure 10C:
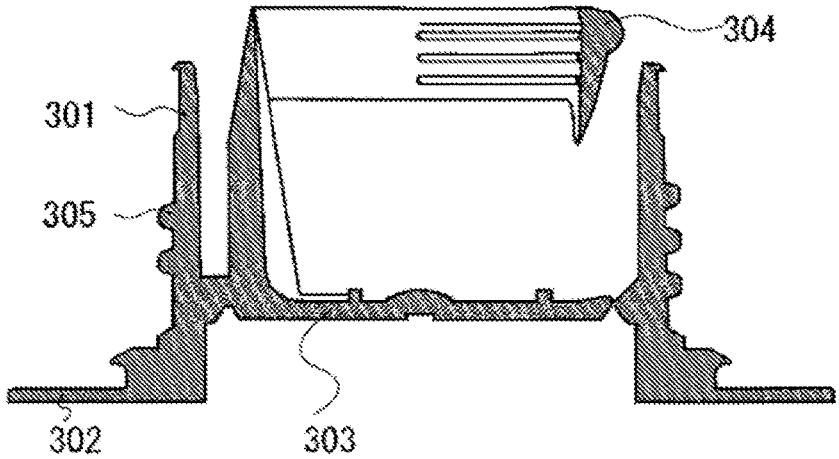
FIG. 10C is a cross-sectional view illustrating a spout according to an embodiment of the present invention.

FIG. 10C shows a spout 104*a*" according to a modification of the spout 104*a*. The spout 104*a*" differs from the spout 104*a* in the presence or absence of the thin portion 306. As shown in FIG. 10C, the spout 104*a*" has no thin portion 306.

The thin portion provided in the spout 104*a* and the spout 104*a*' is at least partially broken, and as will be described later, by folding the container body along the weakened portion.

Figure 11A:
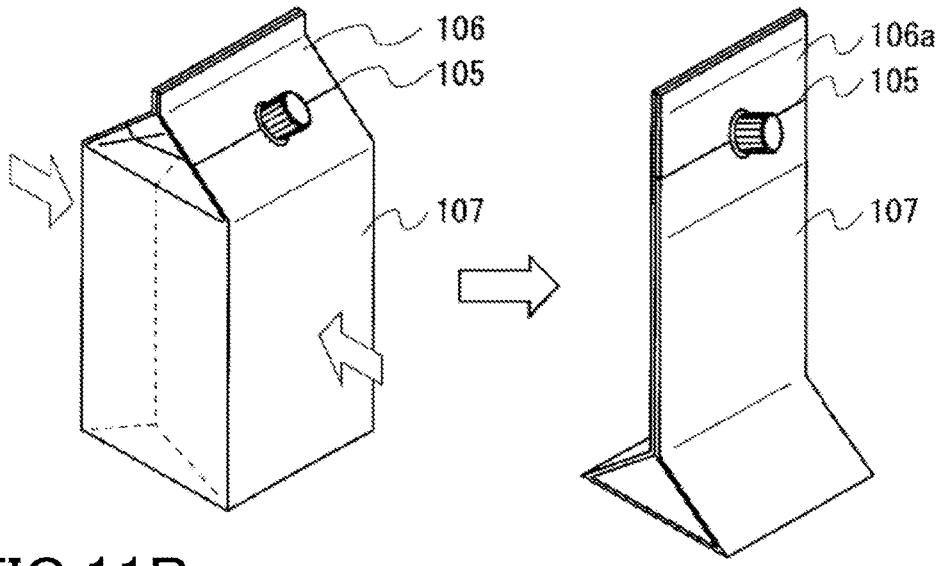
FIG. 11A is a diagram illustrating a disposal method for a packaging container according to an embodiment of the present invention.
Figure 11B:
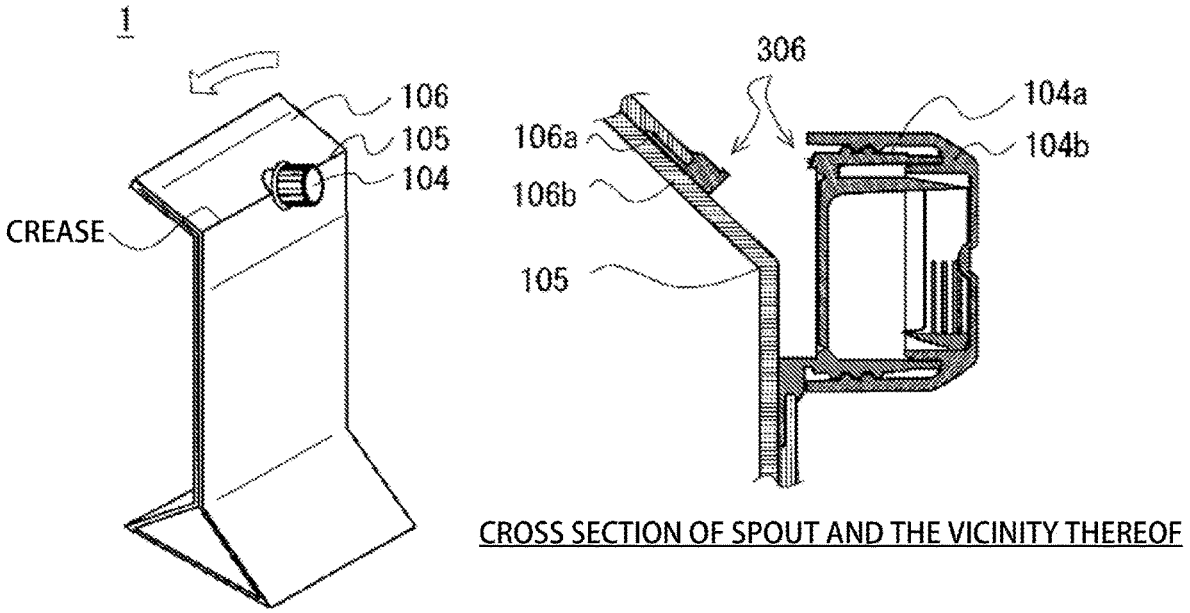
FIG. 11B is a diagram illustrating a disposal method for a packaging container according to an embodiment of the present invention.

FIGS. 11A and 11B show a disposal method according to an embodiment of the present invention. Referring to FIGS. 11A and 11B, individual steps of the present embodiment will be described. The following description addresses a disposal method for the container body 100 and the spout 104*a*, using the blank 10.

<Compressing Step>

FIG. 11A shows a step of compressing the packaging container 1. In this step, the user of the packaging container 1 compresses the body 102 by pushing the two opposed side panels 109 extending below the top panels 106 in a direction of making these side plates contact each other. The two side panels 109 respectively contacting the side panels 109 to be pushed are folded inward of the packaging container 1, and the trunk 102 and the top 101 are compressed.

<First Folding Step>

FIG. 11B shows a step of folding the packaging container 1 along the weakened portion 105. In this step, as shown in FIG. 11B, the user folds the top panels 106 along the weakened portion 105. In this case, a crease created in the top panels 106 crosses over the spout opening 112.

Since the crease created in the top panels 106 crosses over the spout opening 112, part of the flange 302 of the spout 104*a* mounted to the spout opening 112 bears a load and is folded toward the same direction as that of the top panel 106*a*. The spout 104*a*, if provided with the thin portion 306, is at least partially broken, as shown on the right in FIG. 11B, at the thin portion 306 with the imposition of the load.

<Spout Plug Separating Step>

Figure 12A:
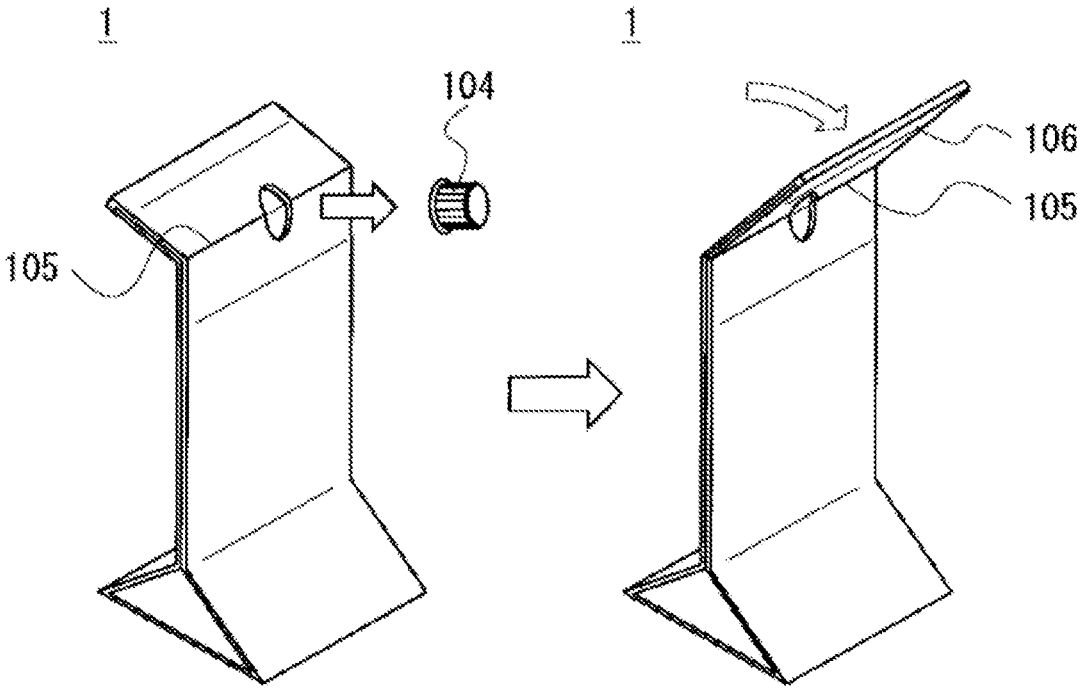
FIG. 12A is a diagram illustrating a disposal method for a packaging container according to an embodiment of the present invention.

FIG. 12A shows on the left a step of separating at least part of the spout plug 104 from the packaging container 1. Since the thin portion 306 of the spout 104*a* has been broken in the previous step, the user can separate the spout plug 104 from the packaging container 1 with only a little strength using this part as a starting point.

<Second Folding Step>

FIG. 12A shows on the right a step of breaking the packaging container 1 along the weakened portion 105. In this step, as shown on the right in FIG. 12A, the user folds the top panels 106 along the weakened portion 105. The top panels 106 may be folded more than once in both directions.

In this step, breaking of the weakened portion 105 proceeds. If the weakened portion 105 has been broken over a sufficient length through the first folding step, the present step may be omitted.

<Top Panel Separating Step>

Figure 12B:
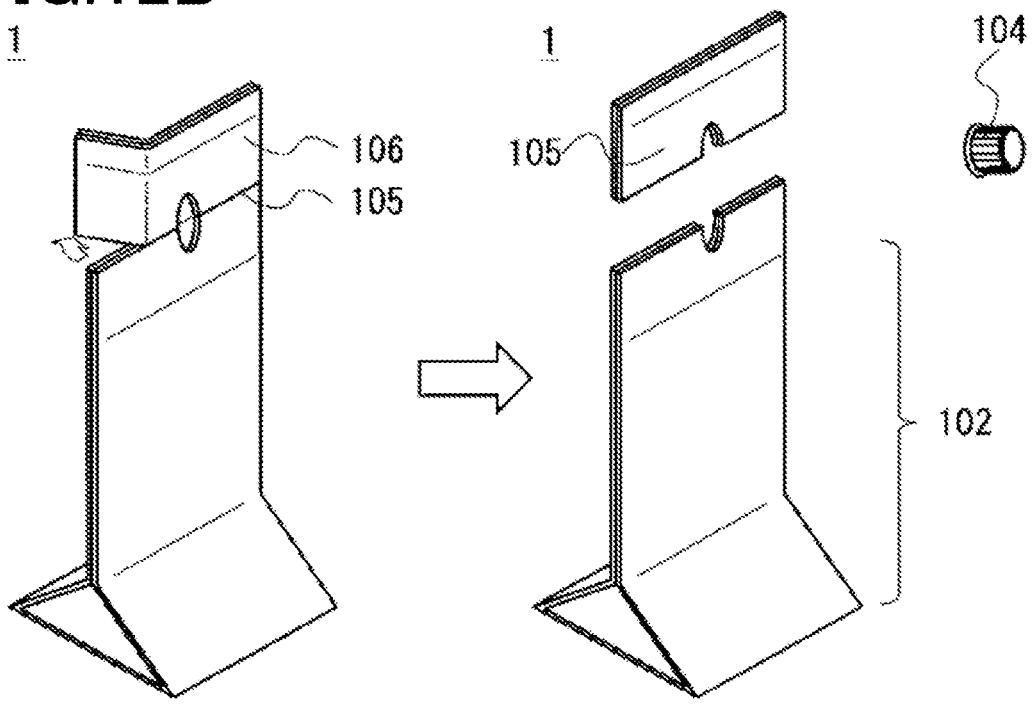
FIG. 12B is a diagram illustrating a disposal method for a packaging container according to an embodiment of the present invention.

FIG. 12B shows on the left a step of separating part of the top panels 106 from the packaging container 1 along the weakened portion 105. In this step, the user tears apart and separates part of the top panels 106 from the packaging container 1 along the weakened portion 105 and the folded portion. Since at least part of the weakened portion 105 has been broken in the previous step, the user can separate the upper part of the top panels 106 with a little strength starting from the weakened portion 105. As shown in FIG. 12B on the right, the packaging container 1 is separated into the upper part of the top panels 106, the trunk 102 and the spout plug 104.

As described above, according to the disposal method, the spout plug can be easily separated with only a little strength. When a weakened portion is provided in the width direction of the packaging container 1, there is a merit of being able to easily grip the container by hand on the upper and lower sides of the weakened portion and easily folding the packaging container 1. At the same time, since part of the top panels 106 can be easily separated from the packaging container 1, the subsequent separation of the trunk is facilitated. Thus, detachment of the spout plug and separation of the trunk can be done in a series of steps, so that it would not be bothersome for the consumers to take the procedure of separation. Since the top including the top sealing portion, which is firmly sealed and difficult to recycle, can be separated from the rest of the packaging container, the packaging container can be appropriately disposed of for recycling. On the other hand, if a weakened portion is provided in the height direction orthogonal to the width direction of the packaging container 1, it is necessary to grip the container by hand on the left and right sides of the weakened portion and to fold the container including the top sealing portion which is firmly sealed and has high stiffness. Therefore, it is difficult to grip the packaging container 1 and a large strength is needed compared to the case where the weakened portion is provided in the width direction. Moreover, it is necessary to cut off the top sealing portion with scissors or the like to separate it from the rest of the packaging container, and thus it is bothersome to dispose of the packaging container suitably for recycling. For this reason, the direction of forming the weakened portion is preferably the width direction rather than the height direction of the packaging container 1.

The disposal method described above can be applied to any of the combinations of the container body produced from the blank 10 or 20, with the spouts 104*a*, 104*a*' or spout 104*a*".

In the case of a container body using a blank 30, almost the same procedure may be taken when separating the packaging container into its constituent parts as in the disposal method described above. Breakage is at least partially caused in the weakened portion 105*b*" as well in the first folding step. Thus, in the spout plug separating step, the spout is entirely separated with ease from the packaging container together with the portion of the container body enclosed by the weakened portion 105*b*. In the case of a container body using the blank 30, the spout 104*a*" having no thin portion may be used instead of the spout 104*a* or 104*a*'.

The present invention is not limited to the embodiments described above, but may be implemented by appropriately combining and modifying the features of the embodiments.

EXAMPLES

Packaging containers according to Examples 1 to 6 and Comparative Examples 1 to 4 were prepared to evaluate the disposal method for the packaging container according to the present invention.

Example 1

The sheet material had a printed layer/LDPE (18 μm)/paper base layer (400 g/m$^2$)/EMAA (30 μm)/barrier layer (alumina vapor deposition+PET base film, 12 μm)/LLDPE (60 μm) in this order from the outside to the inside of the packaging container to be formed. The blank 10 shown in FIG. 2 was prepared using this sheet material, and a packaging container having a capacity of 2,000 ml was prepared using the blank 10.

One half-blanked score line was formed by blade processing, as shown in FIG. 3A, in the LDPE and the paper base layer so as to have a depth of ¾ the thickness of the paper base layer. On the barrier layer, one full-blanked score line was formed by laser beam processing. The barrier layer was irradiated with a laser beam using a carbon dioxide laser device (ML-Z9510 manufactured by Keyence Corporation, the same applies hereinafter) under the conditions of an irradiation output of 70% and a scan speed of 2,500 mm/sec.

The blank that underwent the above processing, with parts thereof being bonded, was shaped, followed by mounting a spout plug to thereby prepare a packaging container.

Liquid contents were injected into the packaging container to confirm no occurrence of leakage or the like and then drained, followed by separating the packaging container using the disposal method of the first embodiment. The packaging container was easily separated.

Example 2

The sheet material had a printed layer/LDPE (18 μm)/paper base layer (400 g/m$^2$)/EMAA (30 μm)/aluminum foil (7 μm)/biaxially stretched PET film (12 μm)/LLDPE (60 μm) in this order from the outside to the inside of the packaging container to be formed. The blank 11 shown in FIG. 5 was prepared using this sheet material, and a packaging container having a capacity of 900 ml was prepared using the blank 11.

One full-blanked score line was formed by blade processing in the paper base layer alone. The score line was formed in a perforated shape where a 10-mm full-blanked portion and a 1-mm connecting portion (non-processed portion) were repeatedly formed. On the barrier layer, one full-blanked score line was formed by laser beam processing. The barrier layer was irradiated with laser beam using a carbon dioxide laser device under the conditions of an irradiation output of 70% and a scan speed of 2,500 mm/sec. This score line was also formed in a perforated shape where an 8-mm half-blanked portion and a 1-mm connecting portion were repeatedly formed.

A packaging container was prepared through the same method as that of Example 1.

Liquid contents were injected into the packaging container to confirm no occurrence of leakage or the like and then drained, followed by separating the packaging container using the disposal method of the second embodiment. The packaging container was easily separated.

Example 3

The sheet material had a printed layer/LDPE (18 μm)/paper base layer (400 g/m$^2$)/EMAA (30 μm)/barrier layer (aluminum vapor deposition+PET base film, 12 μm)/LLDPE (60 μm) in this order from the outside to the inside of the packaging container to be formed. The blank 11 shown in FIG. 5 was prepared using this sheet material, and a packaging container having a capacity of 1,800 ml was prepared using the blank 11.

One half-blanked score line was formed in the printed layer, the LDPE and the paper base layer by blade processing so as to have a depth of ⅔ the total thickness of the printed layer, the LDPE and the paper base layer. The score line was formed in a perforated shape where a 10-mm half-blanked portion and a 1-mm connecting portion were repeatedly formed. On the barrier layer, one full-blanked score line was formed by laser beam processing. The barrier layer was irradiated with laser beam using a carbon dioxide laser device under the conditions of an irradiation output of 70% and a scan speed of 2,000 mm/sec. This score line was also formed in a perforated shape where an 8-mm half-blanked portion and a 1-mm connecting portion were repeatedly formed.

A packaging container was prepared through the same method as that of Example 1.

A packaging container was separated through the same method as that of Example 2. The packaging container was easily separated.

Example 4

The same as the above item 1

A sheet material to be used for the packaging container was prepared by laminating a printed layer/LDPE (18 μm)/paper base layer (400 g/m$^2$)/EMAA (30 μm)/barrier layer (alumina vapor deposition+PET base film, 12 μm)/LLDPE (60 μm) in this order from the outside to the inside of the container to be formed.

The blank 10 shown in FIG. 8 was formed using this sheet material. One half-blanked score line with a depth of ¾ the thickness of the paper base layer was formed as a weakened portion in the printed layer, the LDPE and the paper base layer by blade processing, and one full-blanked score line was formed in the barrier layer by laser beam processing. The barrier layer was irradiated with laser beam using a carbon dioxide laser device (ML-Z9510 manufactured by Keyence Corporation, the same applies to the following examples) under the conditions of an irradiation output of 70% and a scan speed of 2,500 mm/sec.

The ends of the blank processed as mentioned above were bonded to each other to form a container body, followed by mounting a spout 104*a*, thereby producing a packaging container having a capacity of 2,000 ml.

Liquid contents were injected into the packaging container to confirm no occurrence of leakage or the like and then drained, followed by separating the packaging container using the disposal method of the third embodiment. Occurrence of breakage was confirmed in part of the thin portion of the spout in the first folding step, and the spout was easily separated along the broken portions in the spout plug separating step. In the second folding step, breakage was easily caused in the weakened portion.

Example 5

A sheet material to be used for the packaging container was prepared by laminating a printed layer/LDPE (18 μm)/paper base layer (400 g/m$^2$)/EMAA (30 μm)/aluminum foil (7 μm)/biaxially stretched PET film (12 μm)/LLDPE (60 μm) in this order from the outside to the inside of the container to be formed.

The blank 20 shown in FIG. 9A was formed using this sheet material. One full-blanked score line was formed as a weakened portion in the paper base layer by blade processing. This score line was formed in a perforated shape where a 10-mm full-blanked portion and a 1-mm connecting portion (non-processed portion) were repeatedly formed. On the barrier layer, one full-blanked score line was also formed by laser beam processing. The barrier layer was irradiated with a laser beam using a carbon dioxide laser device under the conditions of an irradiation output of 70% and a scan speed of 2,500 mm/sec. The score line in the barrier layer was formed in the same manner as in Example 2 except that the perforation had a repetition of an 8-mm full-blanked portion and a 1-mm connecting portion.

The ends of the blank processed as mentioned above were bonded to each other to form a container body, followed by mounting a spout 104*a*, thereby producing a packaging container having a capacity of 900 ml.

Liquid contents were injected into the packaging container to confirm no occurrence of leakage or the like and then drained, followed by separating the packaging container using the disposal method of the third embodiment. Occurrence of breakage was confirmed in part of the thin portion of the spout in the first folding step, and the spout was easily separated along the broken portions in the spout plug separating step. In the second folding step, breakage was easily caused in the weakened portion.

Example 6

A sheet material to be used for the packaging container was prepared by laminating a printed layer/LDPE (18 μm)/paper base layer (400 g/m$^2$)/EMAA (30 μm)/barrier layer (aluminum vapor deposition+PET base film, 12 μm)/LLDPE (60 μm) in this order from the outside to the inside of the container to be formed.

The blank 30 shown in FIG. 9B was formed using this sheet material. One half-blanked score line was formed as a weakened portion in the printed layer, the LDPE and the paper base layer by blade processing so as to have a depth of ⅔ the total thickness of the printed layer, the LDPE and the paper base layer. The score line was formed in a perforated shape where a 10-mm half-blanked portion and a 1-mm connecting portion were repeatedly formed. On the barrier layer, one full-blanked score line was formed by laser beam processing. The barrier layer was irradiated with laser beam using a carbon dioxide laser device under the conditions of an irradiation output of 70% and a scan speed of 2,000 mm/sec. The score line in the barrier layer was formed in the same manner as in Example 3 except that the perforation had a repetition of an 8-mm full-blanked portion and a 1-mm connecting portion. Further, the weakened portion 105*a*" was formed crossing the weakened portion 105*b*" which was coaxially formed around the spout opening 112 so as to have a radius larger by 7 mm than the spout opening 112.

The blank processed as mentioned above, with its ends being bonded to each other, was shaped, followed by mounting a spout 104*a*", thereby producing a packaging container having a capacity of 1,800 ml.

Liquid contents were injected into the packaging container to confirm no occurrence of leakage or the like and then drained, followed by separating the packaging container using the disposal method of the third embodiment. Occurrence of breakage was confirmed in part of the thin portion of the weakened portion 105*b*" in the first folding step, and the spout was easily separated along the broken portions in the spout plug separating step. In the second folding step as well, breakage was easily caused in the weakened portion 105*a*".

Comparative Example 1

The same sheet material as that of Example 1 was used to prepare a packaging container in the same shape as in Example 1 but without a weakened portion. This packaging container was separated using the same method as in Example 1.

Comparative Example 2

The same sheet material as in Example 2 was used to prepare a packaging container in the same shape as in Example 2 but without a weakened portion. This packaging container was separated using the same method as in Example 1.

Comparative Example 3

The same sheet material as in Example 3 was used to prepare a packaging container in the same shape as in Example 3 but without a weakened portion. This packaging container was separated using the same method as in Example 1.

Comparative Example 4

Using the same sheet material as in Example 1, a weakened portion was formed, which was made up of two score lines having a 15-mm interval therebetween. Using this sheet material, a packaging container having the same shape as in Example 1 was prepared. The packaging container was separated by cutting a portion sandwiched between the two score lines at the bonded portion of the sheet material.

The packaging containers of the above examples and comparative examples were compared to each other in terms of ease of separation and oxygen barrier properties. Oxygen barrier properties were measured at a temperature of 20° C. and a humidity of 60% RH. The results are shown in Table 1. In Table 1, the mark "+" indicates that separation was easy, the mark "−−" indicates that separation was almost impossible, and the mark "−" indicates that separation was possible but not easy.

TABLE 1

| | Sensory evaluation for ease of separation | Oxygen Barrier Properties Unit: cc/pkg · day |
|---|---|---|
| Example 1 | + | 0.12 |
| Example 2 | + | 0.03 |
| Example 3 | + | 0.18 |
| Example 4 | + | 0.12 |
| Example 5 | + | 0.03 |
| Example 6 | + | 0.18 |
| Comparative Example 1 | − − | 0.12 |
| Comparative Example 2 | − − | 0.03 |
| Comparative Example 3 | − − | 0.18 |
| Comparative Example 4 | − | 0.12 |

Separation was made easier when the packaging containers of Examples 1 to 6 were used. When the packaging containers of Comparative Examples 1 to 3 were used, separation was almost impossible. When the packaging container of Comparative Example 4 was used, in some attempts, it was difficult to cut the portion sandwiched between the two score lines at the bonded portion of the sheet material, and in some attempts, peeling occurred between surfaces of the paper base layer, disabling separation. Accordingly, separation was not easy. It was confirmed that the presence or absence of a weakened portion had nothing to do with the oxygen barrier properties.

As a result of the comparison set forth above, it was confirmed that ease of separation was improved by the disposal method of the present invention without posing any problem in oxygen barrier properties.

INDUSTRIAL APPLICABILITY

The present invention is useful, among others, in paper packaging containers or the like accommodating liquid or the like.

REFERENCE SIGNS LIST

1, 2, 3 . . . Packaging container; 10, 11, 12, 13, 14 . . . Blank; 100 . . . Container body; 101 . . . Top; 102 . . . Trunk; 103 . . . Bottom; 104 . . . Spout plug; 104*a* . . . Spout; 104*b* . . . Cap; 105 . . . Weakened portion; 105*a* . . . First weakened portion; 105*b* . . . Second weakened portion; 105*c* . . . Third weakened portion; 106 . . . Top panel; 107 . . . Inward-folding panel; 108 . . . Outward-folding panel; 109 . . . Side panel; 110 . . . Bottom panel; 111 . . . Sealing portion; 112 . . . Spout opening; 113 . . . Cutoff-start section; 20 . . . Sheet material; 21 . . . Thermoplastic resin layer; 22 . . . Paper base layer; 23 . . . Adhesive resin layer; 24 . . . Barrier layer; 24*a* . . . Base film; 24*b* . . . Vapor-deposited layer; 24*c* . . . Metal foil; 25 . . . Adhesive layer; 26 . . . Sealant layer; 27*a*, 27*b* . . . Score line; 28 . . . Printed layer; 301 . . . Side panel; 302 . . . Flange; 303 . . . Partition wall; 304 . . . Pull tab; 305 . . . External screw; 306 . . . Thin portion.

What is claimed is:

1. A packaging container, comprising:

a container body formed by folding a sheet material;

the container body having a trunk, a top and a bottom, with the trunk serving as side panels and the top and the bottom being respectively connected to ends of the trunk;

wherein a first weakened portion is linearly formed in the container body;

the top of the packaging container has a spout opening and a pouring tool made of a resin and mounted to the spout opening; and a crease formed by folding the container body along the first weakened portion crosses over the spout opening.

2. The packaging container of claim 1, wherein the first weakened portion is formed all around the trunk of the packaging container such that parts of the first weakened portion are aligned with each other in plan view when the trunk of the packaging container is compressed.

3. The packaging container of claim 2, wherein the packaging container has a bottom-side part with respect to the first weakened portion, the bottom-side part being provided with a second weakened portion that is linearly formed being extended in a height direction of the trunk.

4. The packaging container of claim 3, wherein the bottom of the packaging container has an edge along which a third weakened portion is linearly formed.

5. The packaging container of claim 1, wherein the first weakened portion extends in a width direction which is a horizontal direction when the container body stands upright.

6. The packaging container of claim 1, wherein:

the sheet material has at least a thermoplastic resin layer, a paper base layer, a barrier layer and a sealant layer arranged in this order from the outside to the inside of the packaging container to be formed; and the first weakened portion is configured by at least a score line provided to the paper base layer and a score line provided to the barrier layer, the score line provided to the barrier layer being aligned with the score line provided to the paper base layer.

7. The packaging container of claim 6, wherein:

the score line provided to the paper base layer is half blanked or full blanked; and the score line provided to the barrier layer is half blanked or full blanked.

8. The packaging container of claim 6, wherein the barrier layer is a deposited film in which a metal layer is vapor-deposited on a base film, a transparent deposited film in which an organic oxide is deposited, a laminated film in which a metal foil is laminated on a base film, or a coating film in which barrier coating is applied to a base film.

9. The packaging container of claim 8, wherein the base film is a stretched film of polyethylene terephthalate.

10. The packaging container of claim 1, wherein the pouring tool is provided with a thin portion which is at least partially broken by folding the container body along the first weakened portion.

11. The packaging container of claim 10, wherein the pouring tool is at least partially separated from the container body by folding the container body along the first weakened portion.

12. The packaging container of claim 1, wherein the first weakened portion is so formed that a part of the first weakened portion can be aligned with the rest of the first weakened portion in plan view when the top of the packaging container is compressed.

13. A disposal method for the packaging container of claim 1, the method comprising:

compressing the trunk and the top of the packaging container;

breaking at least partially the compressed packaging container by folding the same along the first weakened portion linearly formed in the container body; and separating the packaging container along the broken portion extending along the first weakened portion.

14. The disposal method for a packaging container of claim 13, wherein:

the packaging container has a bottom-side part with respect to the first weakened portion, the bottom-side part being provided with a second weakened portion that is linearly formed being extended in a height direction of the trunk; and after the step of separating, the method further comprises a step of cutting part of the packaging container, the part including the bottom, along the second weakened portion.

15. The disposal method for a packaging container of claim 14, wherein:

the bottom of the packaging container has an edge along which a third weakened portion is linearly formed; and after the step of cutting, the method further comprises a step of cutting and separating the bottom from the trunk along the third weakened portion.

16. The disposal method for a packaging container of claim 13, wherein:

in the packaging container, the top of the container body has a spout opening and a pouring tool made of a resin and mounted to the spout opening, and a crease formed by folding the container body along the first weakened portion crosses over the spout opening; and the method further comprises a step of separating at least part of the pouring tool from the packaging container when the packaging container is folded along the first weakened portion.

17. The disposal method for a packaging container of claim 16, wherein the step of separating at least part of the pouring tool from the packaging container includes a step of breaking at least part of the pouring tool along a thin portion formed in the pouring tool.

18. The disposal method for a packaging container of claim 17, wherein, in the step of compressing, at least a part of the first weakened portion is aligned with at least the rest of the first weakened portion in plan view.

* * * * *